US007523760B2

(12) United States Patent
Engesser

(10) Patent No.: US 7,523,760 B2
(45) Date of Patent: Apr. 28, 2009

(54) VALVE ROTATING DEVICE

(76) Inventor: Friedrich Engesser, Ostpreussenweg 29, D-78176 Blumberg (DE)

( * ) Notice: Subject to any disclaimer, the term of this patent is extended or adjusted under 35 U.S.C. 154(b) by 228 days.

(21) Appl. No.: 10/551,707

(22) PCT Filed: Mar. 24, 2004

(86) PCT No.: PCT/EP2004/003122

§ 371 (c)(1),
(2), (4) Date: Jul. 17, 2006

(87) PCT Pub. No.: WO2004/088097

PCT Pub. Date: Oct. 14, 2004

(65) Prior Publication Data

US 2006/0243327 A1 Nov. 2, 2006

(30) Foreign Application Priority Data

Apr. 4, 2003 (DE) ..... 103 15 493

(51) Int. Cl.
*F16K 29/00* (2006.01)

(52) U.S. Cl. ..... 137/331

(58) Field of Classification Search ..... 137/331, 137/56; 251/215

See application file for complete search history.

(56) References Cited

U.S. PATENT DOCUMENTS 3,717,133 A * 2/1973 Enke et al. ..... 137/331

OTHER PUBLICATIONS

PCT International Preliminary Report on Patentability, Translation of PCT Written Opinion of the International Searching Authority, Date of Issuance of the Report Mar. 2, 2006, International Application No. PCT/EP2004/003122.

* cited by examiner

*Primary Examiner*—Kevin L Lee
(74) *Attorney, Agent, or Firm*—John A. Merecki; Hoffman Warnick LLC

(57) ABSTRACT

The invention relates to a valve rotating device comprising a basic body, a cover which is rotatable and axially displaceable relative to the basic body about an axis of rotation, and a rotating device to rotate the basic body relative to the cover about the axis of rotation. In accordance with the invention an increased service life is achieved in that the rotating device has a freewheel which is in operative connection with the cover on the one hand and the basic body on the other hand. In one rotational direction the freewheel can be coupled in a rotationally fixed manner with the cover or the basic body, whereas in the opposite rotational direction the freewheel is rotatable with respect to the cover and the basic body respectively.

10 Claims, 2 Drawing Sheets

VALVE ROTATING DEVICE

FIELD OF THE INVENTION

The invention relates to a valve rotating device comprising a basic body, a cover which is rotatable and axially displaceable relative to the basic body about an axis of rotation, and a rotating device to rotate the basic body relative to the cover about the axis of rotation.

BACKGROUND OF THE INVENTION

Valve rotating devices of such kind are known for instance from DE-AS 1 293 789, U.S. Pat. No. 2,827,886, DE-OS 2 757 455 or from DE-OS 30 04 320. These valve rotating devices are employed in internal combustion engines, in particular in large diesel engines, in which the valve seat and the valve stem are exposed to a relatively high degree of wear. A valve rotating device serves to achieve a uniform thermal loading and therefore wear of the valve and in addition to this makes a decarbonization of the valve seat.

In conventional valve rotating devices the cover is rotatably supported by a disk-shaped cup spring, which rests directly on the balls of the basic body. The balls are arranged in ball pockets with inclined ball races in the basic body whilst being distributed in the circumferential direction, and in doing so the balls are retained by means of tangential springs at an upper point of the inclined ball races. When the valve is opened the cup spring presses on the balls, whereby these roll to the lowest point of the inclined ball races in the basic body. In doing so the cup spring rotates. The tangential springs are compressed. The rotary movement of the cup spring is transmitted via the cover, the valve spring, the upper spring disk and by means of clamping parts to the valve. When the valve closes the cup spring is relieved. The balls are moved back into the initial position again by the tangential springs without rolling. As a result, a rotation only takes place during the opening of the valve, whereas during the closing there is no retrograde rotation. In the case of an upward disposed valve rotating device the basic body can also support itself through a valve spring on the engine block.

It is true that a good rotation is attained with these known valve rotating devices. However, the service life of these known valve rotating devices is limited, as a considerable wear, referred to as pitting formation, is caused on the rotating device both on the balls and on the ball races in the ball pockets.

In the valve rotating device according to WO 01/73270 an appreciable reduction of wear and consequently a corresponding increase in service life is achieved. However, even in the case of this improved valve rotating device the actual rotary movement is brought about by ball races inclined in the axial direction and balls that are being pressed into the ball pockets as a result of the axial valve force.

From U.S. Pat. Nos. 1,414,499 and 1,479,169 rotating devices are known, in which the rotary movement is generated in the manner of a mechanical cam control. A pin is guided in a helical groove of a bushing. In order to transmit the rotary movement in one stroke direction only, an axial coupling having two geared rings lying opposite each other is provided. Here a part of the stroke movement of the valve stem is required as a coupling movement for the coupling and uncoupling and is not available for the rotary movement.

SUMMARY OF THE INVENTION

The invention is based on the object to provide a valve rotating device, which permits a good rotary movement accompanied by a long service life whilst having a simple and compact construction.

In accordance with the invention the object is solved by a valve rotating device having the features of claim 1. Preferred embodiments of the invention are stated in the dependent claims.

The valve rotating device according to the invention is characterized in that the rotating device has a freewheel, the freewheel is connected in a rotationally fixed manner to the cover or the basic body in one rotational direction about the axis of rotation, whereas in the opposite rotational direction the freewheel is rotatable with respect to the cover and the basic body respectively, and in that the freewheel and an axial spring device are enclosed between the basic body and the cover. A fundamental idea of the invention is to dispense with the previously known ball pockets in the basic body with balls arranged therein. In accordance with the invention this is achieved by employing a freewheel, i.e. a directional coupling. By means of the freewheel, which is in operative connection with the cover on the one hand and the basic body on the other hand, a rotationally fixed connection can be established to the basic body or the cover during a rotary movement in one direction, whereas in the opposite direction a torque transmission does not take place from the freewheel to the basic body and the cover respectively. An axial stroke movement is not required for the coupling. Depending on the particular case of application use can be made of simple or more complicated freewheels, such as ratchet freewheels, clamping freewheels, clamping roller freewheels or toothed freewheels etc.

By omitting in the basic body the ball pockets and the balls located therein the related effects of wear, in particular the pitting formation, are eliminated, too. The production of the basic body is thereby facilitated in the entire valve rotating device, and freewheels can also be obtained as finished parts. In addition, the freewheel and the axial spring device are arranged in a particularly compact and protected manner by being enclosed between the basic body and the cup-shaped cover.

Furthermore, in accordance with the invention the rotating device comprises at least one rotating member, through which a rotation of the freewheel with respect to the cover or the basic body can be effected upon an axial displacement between the cover and the basic body. When a relative axial movement takes place between the cover and the basic body the rotating member causes a circumferential deflection about the axis of rotation. Hence, rotation is brought about in a mechanically simple manner.

An embodiment according to the invention consists in that the rotating member is a pin, which is arranged on one side of the freewheel and engages in a groove extending obliquely to the axis of rotation on the cover or the basic body. The groove therefore serves as a connecting link that presets the angle of rotation according to its angle of inclination with respect to the axis of rotation. If the groove is linear-shaped, a corresponding uniform rotary movement results therefrom. However, it is also possible for the groove to extend in the shape of any chosen bent curve so that almost any rotary movement desired between the cover and the basic body can be set. For instance a speed-up or slow-down can take place at the beginning and/or end of the rotary movement, whereby a particularly valve-friendly opening and closing behaviour or an additional cleaning effect can be set.

In order to achieve a particularly wear-reduced behaviour in this link control of the rotary movement it is intended according to the invention that the pin is provided with a friction bearing or a roller bearing. In principle, a single rotating member proves sufficient for a desired rotation. However, two or more rotating members may also be provided so that the load present on the individual rotating members is reduced accordingly.

According to the invention an alternative possibility resides in the fact that the rotating member is a gearing on the freewheel that interacts with a corresponding gearing on the cover or the basic body. Here the gearing is constituted by a helical gearing having a predetermined angle of slope with respect to the axis of rotation.

In principle, use can also be made of other rotating members having a positive and/or negative design, as for example grooves that are semicircular in cross-section and located on the opposite parts, in which balls are guided according to a ballscrew. As part of the rotating device the spring device can equally generate the rotary movement. To this end a helical spring may be provided that generates a torque during the axial tensioning or relieving. This torque can be transmitted in one rotational direction by the freewheel.

A particularly reliable coupling of the freewheel is achieved in accordance with the invention in that the freewheel has at least one coupling member which is displaceably supported in a recess directed perpendicularly to the axis of rotation between a clamping position and a freewheel position.

According to the invention it is preferred that the coupling member is a roller or a ball. As a result, friction effects occurring in the freewheel are reduced further.

Basically, the coupling members are arranged in such a manner in the freewheel that their clamping effect is directed substantially perpendicularly to the axis of rotation of the valve rotating device. Owing to this arrangement the coupling members are practically not loaded by the axially directed valve forces, which have a positive effect on their service life.

For a particularly compact design of the valve device according to the invention provision is made for the freewheel to be designed in the shape of an annular disk, at whose one face at least one coupling member is arranged and at the other face at least one rotating member is arranged. Coupling members can be arranged on the inward-directed face, while the rotating members are fixed to the outward-directed face. For the arrangement of a particularly great plurality of coupling members these may also be provided on the annular outside in releases $\alpha$, while the rotating members are positioned on the annular inner side.

According to the invention effects of friction occurring in the valve rotating device are reduced in that the freewheel is supported in a rotatable manner through a roller bearing and is supported in an axially fixed manner on the basic body or the cover. By using an axial bearing the freewheel can be of a relatively thin design, since it is axially reinforced by the adjoining basic body and the adjoining cover respectively.

In order to press the cover apart from the basic body when these have been pressed against each other through the valve force, an axial spring device is provided in accordance with the invention that is arranged between the cover and the basic body.

For a compact design it is preferred that the axial spring device supports itself on the freewheel. Hence, on one side the axial spring device is rotatably supported together with the freewheel. On the opposite side of the axial spring device an axial bearing, such as a needle bearing, may also be provided.

BRIEF DESCRIPTION OF THE DRAWINGS

In the following the invention will be described in greater detail by way of preferred embodiments schematically illustrated in the drawings, wherein show.

DETAILED DESCRIPTION OF THE INVENTION

Figure 1:
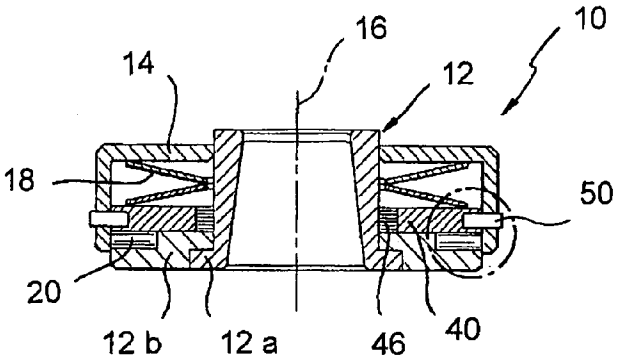
FIG. 1 a schematic cross-sectional view through a valve rotating device according to the invention.

In the assembly drawing of FIG. 1 an inventive valve rotating device 10 having a two-part basic body 12 is shown, which consists of a sleeve-shaped part 12*a* and a disk-shaped part 12*b*. The basic body 12 can be connected to a valve stem, while a cover 14 supported in a rotatable and axially displaceable manner with respect to the basic body 12 can support itself on the engine block by means of a valve spring. Between the cover 14 having the shape of a cylindrical shell and the basic body 12 a disk spring unit is arranged as an axial spring device 18. This device supports itself on the one hand on the cover 14 and on the other hand on a freewheel 40, which is supported through a bearing 20, in particular a needle bearing, in an axially fixed manner on the basic body 12 whilst being rotatable with respect to an axis of rotation 16. The axial spring device 18 and the freewheel 40 are enclosed by the cover 14 and the basic body 12.

Figure 2:
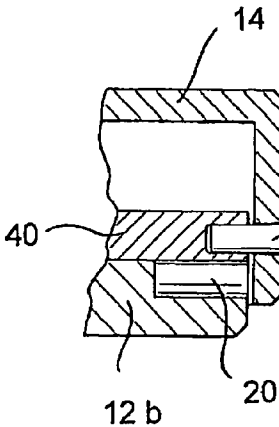
FIG. 2 an enlarged detail view of FIG. 1.

Through schematically depicted coupling members 46 the freewheel 40, having the shape of an annular disk, is in operative connection with the outside of the sleeve-shaped basic body 12*a*. Through these coupling members 46 located on the inner annular face the freewheel 40 can be fixedly connected to the basic body 12 in one rotational direction, whereas in the other rotational direction a relative movement between the freewheel 40 and the basic body 12 is possible. On the other outward lying face of the annular freewheel 40 pins 50 are fixed as a rotating member that extend radially outwards and project into grooves in the cover 14. This arrangement is once again illustrated in an enlarged detail view in FIG. 2.

Figure 3:
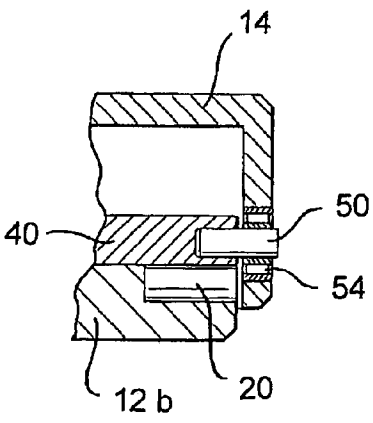
FIG. 3 an alternative embodiment according to the view of FIG. 2.
Figure 8:
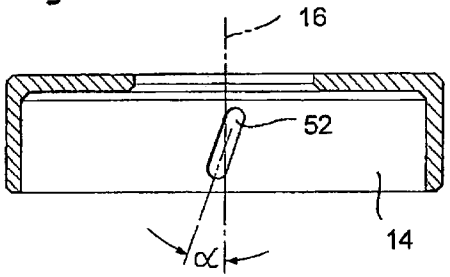
FIG. 8 a schematic cross-sectional view of a cover employed for the valve rotating device according to the invention.

An alternative embodiment of this arrangement of a pin 50 as rotating member is shown in FIG. 3, and here a roller bearing 54 is fixed to the free end of the pin for the purpose of reducing friction. The pin 50 with or without roller bearing 54 serves as a rotating member that engages in a groove 52 in the cover 14 schematically shown in FIG. 8. The groove 52 is positioned with respect to the axis of rotation 16 at a defined angle $\alpha$ that preferably ranges between 5° and 45°. For specific applications larger or smaller angles are possible, too. When the cover 14 is axially pressed relative to the basic body 12 the pin 50, owing to the inclined groove 52, is deflected circumferentially in the manner of a mechanical cam control and can thereby induce a rotation of the freewheel 40. Once the freewheel 40 is coupled with the basic body 12 in a rotationally fixed manner in this rotational direction, the said basic body 12 rotates with the freewheel 40. Hence, this results in a relative rotation between the cover 14 and the basic body 12. When the cover 14 and the basic body 12 are axially pressed apart again by the axial spring device 18, the freewheel 40 rotates back again. However, on account of the opposed rotational direction this retrograde rotation is not transmitted to the basic body 12.

Figure 4:
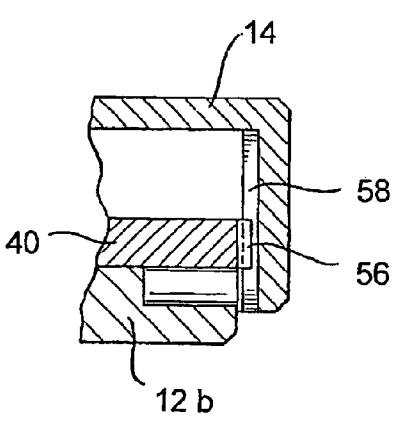
FIG. 4 a further alternative embodiment according to the view of FIG. 2.
Figure 7:
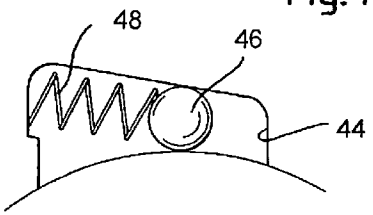
FIG. 7 an enlarged detail view of a release of the freewheel of FIG. 5.

Alternatively, a mechanical cam control of such type can also be achieved by the embodiment according to FIG. 4, in which a first gearing 56 is formed on the annular outside of the freewheel 40 that engages in a corresponding internal gearing 58. The gearings are formed as helical gearings having an angle of slope with respect to the axis of rotation 16 so that when an axial movement takes place a corresponding movement in the circumferential direction results therefrom.

Figure 5:
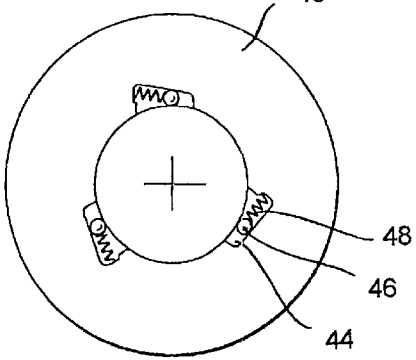
FIG. 5 a schematic enlarged top view of a freewheel employed for a valve rotating device according to the invention.
Figure 6:
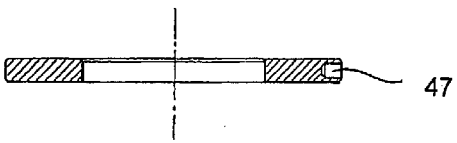
FIG. 6 a part-cross sectional view of the freewheel of FIG. 5.

In FIGS. 5 and 6 an embodiment for a freewheel 40 in the shape of an annular disk is illustrated. On its annular inner side releases 44 are inserted at a regular angular distance of 120° that have a bearing surface extending approximately in the tangential direction. On this bearing surface a ball 46 is arranged as a coupling member that is pressed by a compression spring 48 approximately tangentially towards the annular inner side. On clockwise rotation of the freewheel 40 a clamping or coupling effect is brought about in the arrangement according to FIG. 5, which results in a rotationally fixed connection between the freewheel 40 and the basic body 12 for example. In the opposite rotational direction, however, the ball-shaped coupling members 46 are pressed into the rear recess of the release 44 so that a free rotation of the basic body 12 with respect to the freewheel 40 is rendered possible. According to FIG. 6 a bore 47 is provided on the outside of the freewheel 40 in order to receive the pin-shaped rotating member.

The invention claimed is:

1. Valve rotating device comprising a basic body, having a disk-shaped part and an inner sleeve-shaped part;

a cup-shaped cover with an outer cylindrical wall, the cover being rotatable and axially displaceable relative to the basic body about an axis of rotation; and a rotating device to rotate the basic body relative to the cover about the axis of rotation;

wherein the rotating device has an annular disk-shaped freewheel, at whose inner annular face at least one coupling member is arranged and in operative connection with the outside of the sleeve-shaped part of the basic body;

the freewheel is connected in a rotationally fixed manner to the sleeve-shaped part of the basic body in one rotational direction about the axis of rotation, whereas in the opposite rotational direction the freewheel is rotatable with respect to the sleeve-shaped part of the basic body; and the basic body with the disk-shaped part and the inner sleeve-shaped part and the cup-shaped cover with the outer cylindrical wall enclosing an annular space, in which the annular disk-shaped freewheel and an axial spring device are arranged.

2. Valve rotating device according to claim 1, wherein the rotating device comprises at least one rotating member, through which a rotation of the freewheel with respect to the cover or the basic body can be effected upon an axial displacement between the cover and the basic body.

3. Valve rotating device according to claim 2, wherein the rotating member has a pin which is arranged on one side of the freewheel and engages in a groove extending obliquely to the axis of rotation on the cover or the basic body.

4. Valve rotating device according to claim 3, wherein the pin is provided with a friction bearing or a roller bearing.

5. Valve rotating device according to claim 2, wherein the rotating member has a first gearing located on the freewheel that interacts with a corresponding second gearing located on the cover or the basic body.

6. Valve rotating device according to claim 1, wherein the coupling member is displaceably supported in a recess directed perpendicularly to the axis of rotation between a clamping position and a freewheel position.

7. Valve rotating device according to claim 6, wherein the coupling member is a roller or a ball.

8. Valve rotating device according to claim 1, wherein the freewheel is supported in a rotatable and axially fixed manner on the basic body or the cover through a bearing.

9. Valve rotating device according to claim 1, wherein the axial spring device is arranged between the cover and the basic body.

10. Valve rotating device according to claim 9, wherein the axial spring device supports itself on the freewheel.

* * * * *